United States Patent [19]

Jonsson et al.

[11] Patent Number: 4,718,646

[45] Date of Patent: Jan. 12, 1988

[54] LADLE HEAD

[75] Inventors: Lars Jonsson; Mats Johansson, both of Lidingö , Sweden

[73] Assignee: AGA Aktiebolag, Lidingo, Sweden

[21] Appl. No.: 872,575

[22] Filed: Jun. 10, 1986

[30] Foreign Application Priority Data

Jun. 10, 1985 [SE] Sweden ..... 8502863

[51] Int. Cl.[4] ..... C21C 5/42

[52] U.S. Cl. ..... 266/242; 266/287; 266/901

[58] Field of Search ..... 266/287, 214, 217, 225, 266/218, 242, 275, 900, 901

[56] References Cited

U.S. PATENT DOCUMENTS

| | | | |
|---|---|---|---|
| 2,065,691 | 12/1936 | Hanson et al. | 266/217 |
| 2,878,115 | 3/1959 | Schane, Jr. et al. | 266/225 |
| 3,519,259 | 7/1970 | Death et al. | 266/225 |
| 3,734,719 | 5/1973 | Estes et al. | 266/225 |

FOREIGN PATENT DOCUMENTS

| | | |
|---|---|---|
| 0048007 | 9/1980 | European Pat. Off. . |
| 0098032 | 2/1940 | Sweden . |
| 0168346 | 8/1959 | Sweden . |
| 0329470 | 10/1970 | Sweden . |

*Primary Examiner*—L. Dewayne Rutledge
*Assistant Examiner*—S. Kastler
*Attorney, Agent, or Firm*—Pollock, Vande Sande & Priddy

[57] ABSTRACT

A head which is intended to be mounted on a ladle, is provided inside with refractory material. At least one burner for liquid or gaseous fuel and oxygen gas for heating the melt in the ladle is disposed in the head. The head is provided with retainer means for the burner, by the intermediary of which the burner is axially shiftably disposed in relation to the surface of the melt bath and is rotatably disposed in relation to the vertical line of the burner to the surface of the melt bath. Depending upon the burner output, the burner is adjustable so as to emit the best possible heat transfer from the burner flame to the melt bath and, at the same time, to cause the slightest possible chemical action on the melt bath.

2 Claims, 2 Drawing Figures

LADLE HEAD

TECHNICAL FIELD

The present invention relates to a head intended to be applied on a ladle, the inside of the head being fitted with a refractory material and at least one burner being disposed in the head for liquid or gaseous fuel and oxygen gas for heating the melt in the ladle.

BACKGROUND ART

Within the steel metallurgy art, the high demands placed on productivity and quality have resulted in a division of this art into primary metallurgical (melting in light arc furnaces, converters) and secondary metallurgical (refining) processes. One factor common to all secondary metallurgical processes is temperature loss. Consequently, a possibility for rational heating is desirable so as to render these secondary metallurgical processes more efficient and to make for their development, with the purpose of relieving the primary furnace from the requisite overheating work and of reducing the overheating, and finally to save energy.

Such a heating technological improvement would find immediate application in continuous casting plants. This technology also provides the opportunity for diversified secondary metallurgical treatments, which influence the utilization frequency of processes such as injection in metallurgical processes.

OBJECT OF THE INVENTION

The object of the present invention is to provide an apparatus for use of this heating technology. The apparatus is used for heating the melt in a ladle and comprises a head which is provided with a refractory material and is mounted on the ladle. One or more burners for liquid or gaseous fuel and oxygen gas are disposed in the head. According to the present invention the head is designed with retainer members for the burner, by means of which the burner is axially shiftably disposed in relation to the surface of the melt bath and is rotatably disposed in relation to the vertical line of the burner to the surface of the melt bath. Depending upon the burner effect, the burner is arranged so as to emit the best possible thermal transfer from the flame to the melt bath and, at the same time, to cause the slightest possible chemical action on the melt bath. The present invention is further characterised in that the distance from the burner nozzle to the surface of the melt bath is adjustable in the range of from 10 to 100 cm and that the burner is rotatable in relation to the vertical line to the surface of the melt bath within the angular range of from 0° to 60°.

The nature of the present invention and its aspects will be more readily understood from the following brief description of the accompanying Drawing, showing one embodiment of a head for a ladle according to the present invention, and discussion relating thereto.

BRIEF DESCRIPTION OF THE ACCOMPANYING DRAWING

FIG. 2 is a diagram showing the temperature increase per minute in the melt as a function of the burner output.

DESCRIPTION OF PREFERRED EMBODIMENT

Figure 1:
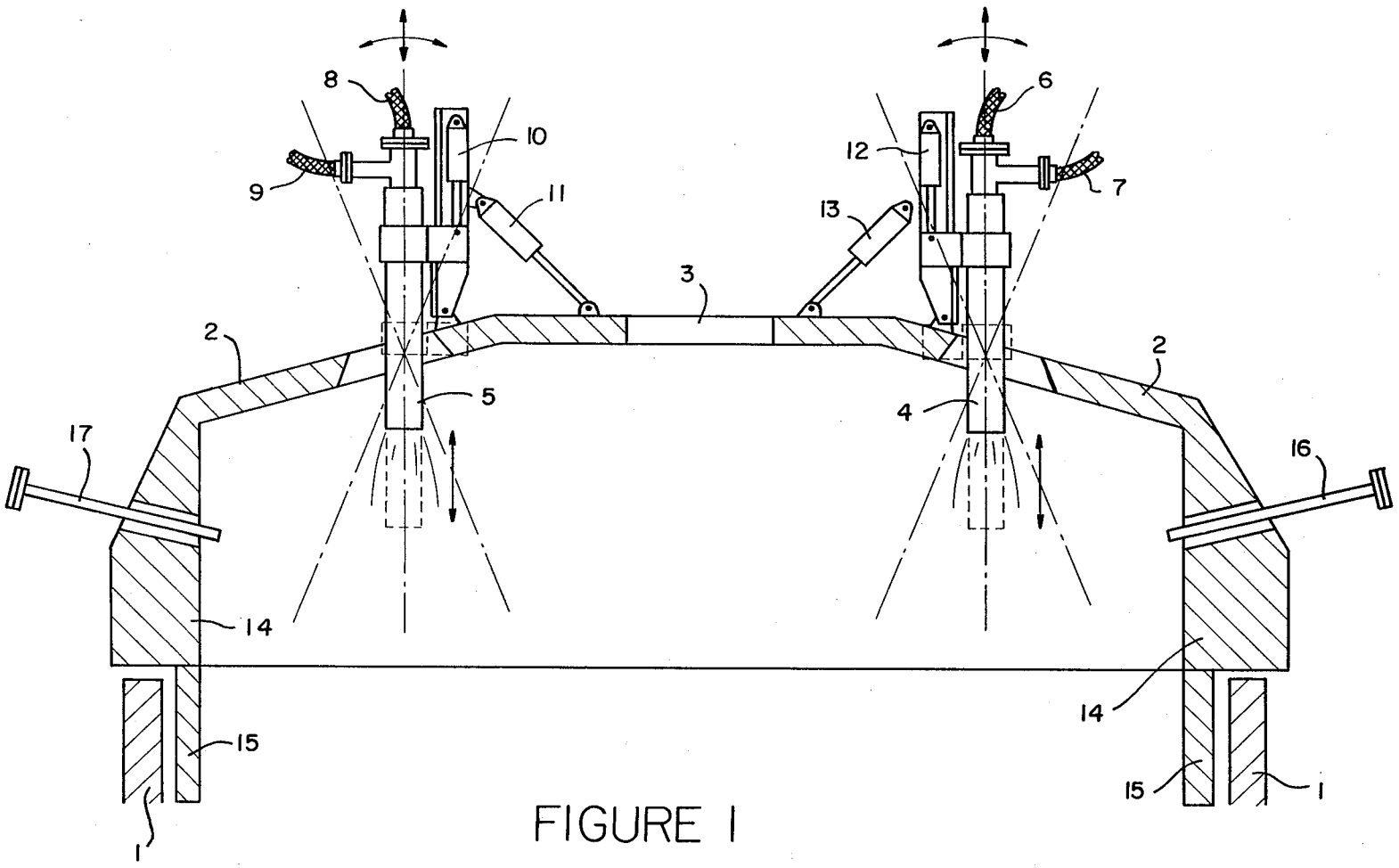
FIG. 1 shows one embodiment of the present invention ladle head.

Referring to the FIG. 1, the head connects to the ladle walls 1. In the upper, slightly arcuate portion 2 of the head, there are disposed so-called oxy-fuel burners. Two burners 4 and 5 are shown on the Drawing, but in the preferred embodiment, three burners are employed, these being located symmetrically in the head. The burners 4 and 5 are supplied with a liquid or gaseous fuel through the connections 7 and 9, respectively, and with oxygen gas through the connections 6 and 8, respectively. The burners 4 and 5 are disposed in retainer means which, by the intermediary of devices 12 and 10, respectively, are shiftable towards and away from the surface of the melt bath and, by the intermediary of devices 13 and 11, respectively, are rotatably disposed so that they may be rotated in relation to the vertical line of the burner to the surface of the melt bath.

In the vertical portion 14 of the head, the inner diameter of the head has been made considerably smaller than the inner diameter of the ladle. In this instance, the inner diameter of the head is so much smaller than the inner diameter of the ladle that the ladle wall is screened-off from the burner flame. In order further to protect the ladle wall between the head and the surface of the melt bath, a cylinder 15 is disposed at the inner periphery of the head. The cylinder may be made a refractory material, such as ceramics, or may be water-cooled. As a result, that portion of the ladle wall which is located above the surface of the melt bath will be protected.

Through passages 16, for example three in number, are symmetrically arranged in the vertical walls of the head. So-called lances 17 are disposed in these through passages, by means of which oxygen gas is supplied to the space between the head and the surface of the melt bath. The secondary oxygen gas replaces, to some extent, the oxygen gas fed through the burners. As a result of this supply of oxygen gas, a rotational movement will be imparted to the volume of gas under the head. The through passages are so designed that the lances may assume a horizontal position, i.e. parallel to the surface of the melt bath. In the horizontal plane, the lance is rotatable in relation to the radius of the head in the pivotal point within the angular range of from 10° to 80°. In its bottom portion, the ladle is further provided with tuyere apparatus serving, for example, for argon blowing into the melt to cause agitation of the melt.

Using an apparatus described above, molten steel from a light arc furnace was, in a series of experiments, heated in a 10 ton ladle. The rate of cooling of the ladle with heating equipment but without the burner in operation, was mapped-out for reference purposes. At different burner outputs, the distance and alignment of the burner were varied in relation to the surface of the melt bath. Thus, the temperature increase of from 2° to 3° C. per minute which was attained in the melt is dependent upon the supplied output and upon the distance and alignment of the burner in relation to the surface of the melt bath. It is important, in this context, that the heating equipment be arranged so as to be at the highest possible temperature already at start-up, in order to obtain an efficient background thermal radiation. FIG. 2 is a curve diagram showing the temperature increase per minute in the melt as a function of the burner output. The upper curve represents a burner distance of 50 cm and the lower curve portion a distance of 60 cm. It will be apparent from these curves that, in, for example, an output of 90 kW/tonne, there will be obtained, at a burner distance of 50 cm, a temperature increase in the melt of approx. +0.3° C./min., while at a burner distance of 60 cm, there will be obtained a temperature reduction of approx. −0.6° C./min.

In conjunction with heating of the melt in the ladle, it is of importance that the burner flame cause as slight a chemical action as possible on the melt. In this instance, it proves that the elements in the melt will be oxidised in a natural manner. The elements possessing the greatest oxygen affinity will be oxidized first and, when complete reduction has been reached, oxidation of the next element will occur, and so on. The results of measurement of the hydrogen content show that burner operation occasions no alteration to the flame compositions examined.

What we claim and desire to secure by Letters Patent is:

1. A head for a ladle comprising:

a horizontal part and a vertical part, both parts having inside walls provided with a refractory material;

at least one burner disposed in said horizontal part for supplying liquid or gaseous fuel and oxygen gas for heating the melt in the ladle;

retaining means for the burner mounted on said horizontal part for axial movement of said burner in relation to the surface of the melt bath and adapted for adjustment of an angle between the vertical line of the burner and the surface of the melt bath;

said vertical part including an upper and a lower cylindrical part, said lower part having an outer diameter of the cylinder wall smaller than the inner diameter of the ladle wall, and extends axially so as to substantially cover the ladle wall between the head and the surface of the melt bath, said upper part including horizontally disposed passage means in which lances are arranged, for supplying oxygen to the space between the head and the surface of the melt bath; and wherein a portion of the total quantity of the oxygen supplied to the head being fed to the burner and the remaining portion being fed to the lances, the oxygen gas fed through the lances providing a rotational movement of the body of gas beneath the head for increasing the thermal transmitting capacity.

2. A head for a ladle according to claim 1 wherein said lances are disposed parallel to the melt surface and rotatable in the horizontal plane with respect to the radius of the head in the pivotal point within the angular range from 10° to 80°.

* * * * *